US007052194B2

(12) United States Patent
Mills

(10) Patent No.: US 7,052,194 B2
(45) Date of Patent: May 30, 2006

(54) APPARATUS AND METHOD FOR CONTROLLING A RIBBON TRANSPORT MECHANISM

(75) Inventor: Paul Mills, Newark (GB)

(73) Assignee: Markem Technologies Limited (GB)

( * ) Notice: Subject to any disclaimer, the term of this patent is extended or adjusted under 35 U.S.C. 154(b) by 0 days.

(21) Appl. No.: 10/828,409

(22) Filed: Apr. 20, 2004

(65) Prior Publication Data

US 2005/0042010 A1 Feb. 24, 2005

(30) Foreign Application Priority Data

Apr. 22, 2003 (GB) ..... 0309039
Nov. 17, 2003 (GB) ..... 0326656

(51) Int. Cl.
*B41J 33/14* (2006.01)
*B41J 35/04* (2006.01)

(52) U.S. Cl. ..... 400/248; 400/234; 400/236; 400/225; 242/344; 242/346

(58) Field of Classification Search ..... 400/223, 400/225, 234, 236, 247, 248, 248.3, 249; 242/342, 344, 346, 346.1, 346.2
See application file for complete search history.

(56) References Cited

U.S. PATENT DOCUMENTS 5,529,410 A 6/1996 Hunter et al.
5,873,662 A 2/1999 Clevinger
5,975,777 A * 11/1999 Nelson et al. ..... 400/223

FOREIGN PATENT DOCUMENTS

| | | | |
|---|---|---|---|
| EP | 1253018 | 10/2002 | |
| GB | 2 150 501 | 7/1985 | |
| GB | 2 372 724 | 9/2002 | |
| JP | 62-273878 | * 11/1987 | ..... 400/234 |
| JP | 63-276586 | * 11/1988 | ..... 400/234 |
| JP | 64-8076 | * 1/1989 | ..... 400/234 |
| JP | 01-262178 | * 10/1989 | ..... 400/234 |
| JP | 6-270489 | 9/1994 | |
| WO | WO 03/029013 | 9/2002 | |

OTHER PUBLICATIONS

UK Patent Office searches, dated Aug. 26, 2003 and May 7, 2004.

* cited by examiner

*Primary Examiner*—Leslie J. Evanisko
(74) *Attorney, Agent, or Firm*—Fish & Richardson P.C.

(57) ABSTRACT

An apparatus for controlling a ribbon transport mechanism of a ribbon feed system includes a supporting structure carrying a plurality of ribbon transport devices including a ribbon storage spool, a ribbon take-up spool, and at least one ribbon guide around which roller the ribbon is passed, a ribbon feed path including the ribbon guide, between the storage and take-up spools and through an operating station where a work operation is carried out which utilises the ribbon, the ribbon transport mechanism in use, transporting the ribbon along the ribbon feed path between the storage and take-up spools, the apparatus including a mounting structure for mounting at least one of the ribbon transport devices so as to permit the respective device to move relative to the supporting structure in response to changes in ribbon tension occurring in the ribbon feed path, and a sensor device which is sensitive to such movements to provide an input which is dependant upon the extent of such spool movement, to a controller, the controller controlling operation of the transport mechanism in response.

21 Claims, 3 Drawing Sheets

APPARATUS AND METHOD FOR CONTROLLING A RIBBON TRANSPORT MECHANISM

CLAIM OF PRIORITY

This application claims the benefit of foreign priority under 35 U.S.C. § 119 to applications filed in Great Britain, serial number 0309039.6, filed Apr. 22, 2003, and serial number 0326656.6. filed Nov. 17, 2003, the entire contents of which are hereby incorporated by reference.

BACKGROUND TO THE INVENTION

This invention relates to an apparatus for controlling a ribbon transport mechanism of a ribbon feed system, such as for example only, in a printer. Such a printer typically includes a ribbon storage spool for storing ribbon, and a ribbon take-up spool for taking up used ribbon, a ribbon path between the storage and take-up spools though an operating station where a print head is provided. In use the print head may move relative to the stationary ribbon, or the ribbon may move relative to the stationary or moving print head, whilst the print head is actuated to remove marking medium from the ribbon and to deposit the marking medium on to a substrate.

The ribbon tends to be thin and physically of restricted strength, with the result that the ribbon may break if subjected to too much tension. Thus precise control of the ribbon tension is desirable to ensure print quality and to ensure that the ribbon is uniformly wound onto the take-up spool. Accordingly it is a requirement in such a ribbon feed system carefully to control the tension of the ribbon as it is transported along the ribbon feed path from the storage to the take-up spool.

DESCRIPTION OF THE PRIOR ART

In one prior proposal, in which the take-up spool is driven to transport the ribbon, and the storage spool is dragged, the storage spool is provided with a slipping clutch in an effort to maintain ribbon tension within boundary values. However, particularly where the storage spool is relatively full compared to the take-up spool, the inertia of the storage spool can result in substantial tension on the ribbon when the ribbon transport mechanism is operated, leading to ribbon breakage.

In another prior proposal, in which both the storage and take-up spools are driven by respective motors during ribbon transport, a measure of ribbon tension is obtained by determining the level of current consumed by one or other of the motors. However this is a complex solution requiring pre-calibration of the motors used to determine their overall drive characteristics.

SUMMARY OF THE INVENTION

According to one aspect of the invention we provide an apparatus for controlling a ribbon feed mechanism of a ribbon feed system which includes a supporting structure supporting a plurality of ribbon transport devices including a ribbon storage spool, a ribbon take-up spool, and at least one ribbon guide around which the ribbon is passed, there being a ribbon feed path including the ribbon guide, between the storage and take-up spools through an operating station where a work operation is carried out which utilises the ribbon, the ribbon transport mechanism in use, transporting the ribbon along the ribbon feed path between the storage and take-up spools, the apparatus including a mounting structure for mounting at least one of the ribbon transport devices so as to permit the respective device to move relative to the supporting structure in response to changes in ribbon tension occurring in the ribbon feed path, and a sensor device which is sensitive to such movements to provide an input which is dependant upon the extent of such movement, to a controller, the controller controlling operation of the ribbon transport mechanism in response.

Thus utilising the present invention, a relatively simple and inexpensive means for controlling ribbon tension may be provided which is independent of motor characteristics or motor type, so that the transport mechanism may more accurately be controlled to avoid ribbon breakage.

Each of the spools may be rotatable about a respective rotational axis which may be generally normal to the direction of ribbon movement around the ribbon feed path, and the ribbon guide roller too may have an axis generally normal to the direction of ribbon movement.

The sensed movement of the respective ribbon transport device relative to the supporting structure, may be in a direction transverse to the direction of the respective axis.

In one arrangement, the apparatus of the invention is for use with a ribbon feed system in which both the ribbon take-up, and ribbon storage spools are driven for rotation about their respective axes of rotation, during ribbon transport, the spools being driven during or after a work operation is carried out utilising the ribbon. However the invention may be applied to an apparatus in which the take-up spool only is driven, or to an apparatus in which ribbon feed is achieved by rotating a roller around which the ribbon is passed along the ribbon feed path.

In one embodiment the apparatus includes for the storage spool, a first mounting structure, and for the take-up spool, a second mounting structure, both of the first and second mounting structures permitting respective spool movements relative to the supporting structure in response to changes in ribbon tension, and there being a sensor device for each mounting structure to sense spool movements attributable to changes occurring in the ribbon tension. Thus both sensor devices may provide respective inputs to the controller which may control the ribbon transport mechanism in response. For example the ribbon transport mechanism may include a motor for each of the storage and take-up spools, which motors may individually be controlled by the controller in response to the inputs from the respective sensor devices, to maintain ribbon tension within predetermined values.

It will be appreciated that as the amount of ribbon on each of the storage and take-up spools changes as ribbon is wound onto the take-up spool, and particularly as the ribbon diameters on the -respective spools change, ribbon tension will be affected, and resulting movements of the or the respective spools on the or their respective mounting structures due to changes in ribbon tension, will change.

Typically the controller would determine a measure of the or at least one of the respective spool diameters, in order to control rotation of the spools to achieve a desired amount of ribbon feed during and/or subsequent to a work operation. This may be achieved by calculation or by ribbon diameter measurement as desired.

Accordingly, preferably the controller not only uses information received from the sensor device or devices, but also uses information indicative of the amount of ribbon, e.g. of the ribbon diameter on at least one of the spools in order to control the ribbon transport mechanism operation to control the ribbon tension.

Although the spool or spools may be mounted on the supporting structure by any suitable kind of mounting structure, the or each mounting structure may include a spool mounting part provided in an opening in the supporting structure. The spool mounting part may be attached to the supporting structure by a connecting member which permits the spool mounting part, and hence the spool, to move relative to the supporting structure in response to changes in ribbon tension. For example, the supporting structure may include a plate-like member providing the opening, and the connecting member may include a bridge which is integral with the plate-like member and the spool mounting part. In this case the sensor device may include a transducer which may be provided between the supporting structure and the spool mounting part to sense movements of the spool mounting part relative to the supporting structure in response to changes in ribbon tension. The or each transducer may be a proximity sensor, a strain gauge or any transducer or combination of transducers.

The opening in the supporting structure in which the spool mounting part is provided, may substantially surround the spool mounting part or may be provided at an edge of the supporting structure.

Preferably, the spool mounting part includes a spindle on which the spool is mounted and around the axis of which the spool is rotatable. It will be appreciated that changes in ribbon tension will tend to be transmitted to the spindle and hence to the spool mounting part, resulting in spool mounting part movements relative to the supporting structure.

The spindle may be an idler spindle but preferably the spindle is a driven shaft of a motor the rotation of which to achieve ribbon transport, is controlled by the controller. Thus the motor is preferably provided on the spool mounting part.

In another embodiment, movements of the ribbon guide relative to the support structure in response to changes in ribbon tension, may be sensed.

Although the ribbon guide may be a simple post around which the ribbon passes, desirably the ribbon guide is a roller of a roller assembly.

For one example, the mounting structure may mount the roller assembly on the supporting structure, at or towards one end of the roller, the mounting structure constraining the roller to move in a direction generally transverse to the direction of its longitudinal axis, e.g. normally, in response to changes in tension in the ribbon in the ribbon feed path, the sensor device including at least one proximity sensor, such as Hall effect sensor, provided on the supporting structure at or towards an opposite end of the roller to the mounting structure, to sense roller movements occurring in response to changes in ribbon tension, and to provide the input to the controller.

The mounting structure may for example include a pair of spaced apart leaf springs arranged generally parallel to each other and to the axis of rotation of the roller, the leaf springs being interconnected by upper and lower connecting members which each extend generally normally to the axis of rotation of the roller, whereby in response to changes in tension of the ribbon along the ribbon feed path, the springs resiliently distort to constrain the roller to move transversely sideways in a direction generally normally to the direction of its longitudinal axis.

For another example, the mounting structure may mount a spindle of the roller assembly on the supporting structure at or towards the one end of the roller, an end part of the roller assembly at or towards an opposite end of the roller being received by a housing which includes the sensor device and which sensor device senses movements of the end part in response to changes in ribbon tension, to provide the input to the controller. The sensor device may in this example include at least one strain gauge or similar solid state transducer or combination of transducers.

In each of the examples of the second embodiment, but particularly the second example, the roller may carry a magnet, rotation of the roller being sensed by a Hall effect sensor, or the like, whereby the amount of ribbon on each of the storage and take-up spools which changes as ribbon is wound onto the take-up spool, and particularly as the ribbon diameters on the respective spools change, may be determined, so that the controller may appropriately control operation of the ribbon transport mechanism, e.g. spool rotation, to feed an appropriate amount of the ribbon for the work operation.

According to a second aspect of the invention we provide a, method of controlling a ribbon transport mechanism of a ribbon feed system which includes a supporting structure carrying a plurality of ribbon transport devices including a ribbon storage spool, a ribbon take-up spool, and at least one ribbon guide around which the ribbon is passed, a ribbon path including the ribbon guide, between the storage and take-up spools through an operating station where a work operation is carried out which utilises the ribbon, the ribbon transport mechanism in use, transporting the ribbon along the feed path between the storage and take-up spools, the method including providing at least one of the ribbon transport devices on a mounting structure which permits the respective device to move relative to the supporting structure in response to changes in ribbon tension occurring in the ribbon feed path, and sensing such movements with a sensor device, providing an input which is dependant upon the extent of such movements, from the sensor device to a controller, and controlling operation of the ribbon transport mechanism in response.

The method of the second aspect of the invention may include sensing movements of both of the ribbon storage and take-up spools in response to changes in ribbon tension, with respective sensor devices, and providing inputs dependent upon the extents of spool movements from the sensor devices to the controller.

Alternatively, the method may include sensing movements of the ribbon guide relative to the support structure, in response to changes in ribbon tension, with a sensor device, to provide the input to the controller.

According to a third aspect of the invention we provide a method of determining when a ribbon in a ribbon feed system has broken, the ribbon feed system including in a supporting structure carrying a plurality of ribbon transport devices including a ribbon storage spool, a ribbon take-up spool, and at least one ribbon guide around which the ribbon is passed, there being a ribbon feed path including the ribbon guide, between the storage and take-up spools through an operating station where a work operation is carried out which utilises the ribbon, and a ribbon transport mechanism for transporting the ribbon along the ribbon feed path between the storage and take-up spools, the method including providing at least one of the ribbon transport devices on a mounting structure which permits the respective device to move relative to the supporting structure in response to changes in ribbon tension occurring in the ribbon feed path, and sensing with a sensor device, such a movement of the or one of the ribbon transport devices which indicates that the ribbon has broken, and providing an input from the sensor device to a controller which operates an indicating device which indicates that the ribbon has broken.

BRIEF DESCRIPTION OF THE DRAWINGS

Embodiments of the invention will now be described with reference to the accompanying drawings in which.

DESCRIPTION OF THE PREFERRED EMBODIMENT

Figure 1:
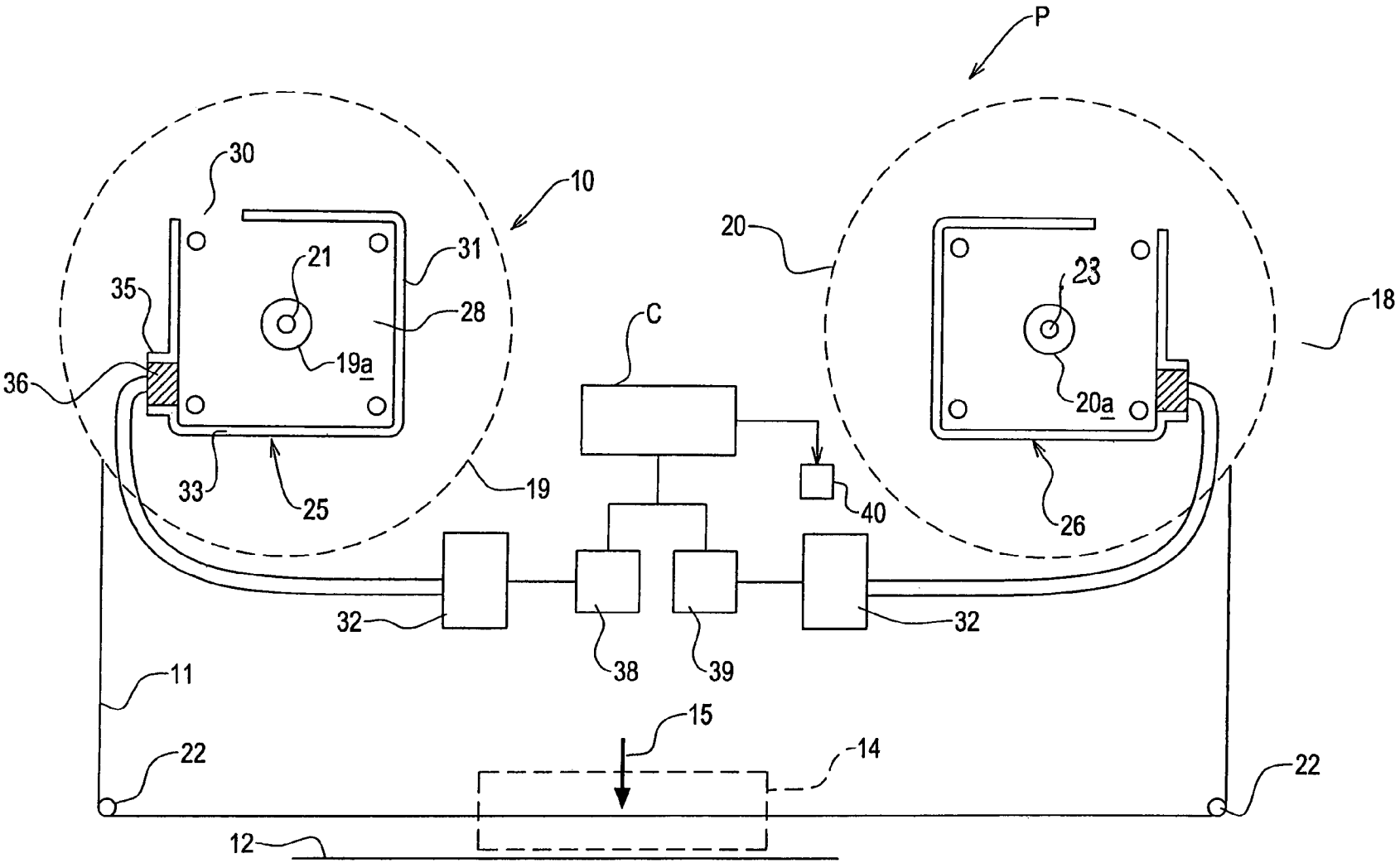
FIG. 1 is an illustrative view of a first embodiment of a ribbon feed system and an apparatus for determining ribbon tension in accordance with the invention.

Referring to FIG. 1 of the drawings, a ribbon feed system 10 is part of a printing machine P in this example. Ribbon 11 is coated with marking medium or ink, which is deposited on a substrate 12 during a printing operation, carried out at a operation station 14, where a print head 15 is provided. In this example, the print head 15 is a so called thermal print head having a plurality of heating elements arranged in a linear array which is transverse to the direction of movement of the ribbon 11 through the printing machine P. During printing, while there is relative movement between the print head 15 and the substrate 12, the heating elements are selectively energised, to melt and thus remove pixels of marking medium from the ribbon 11, which pixels are deposited on the substrate 12. The ribbon 11 may be stationary during printing with the print head 15 moving along the ribbon 11 and substrate 12, or vice versa, or the ribbon 11 and substrate 12, and the print head 15 may all be relatively moving.

Thus either after a printing operation, and/or during printing the ribbon 11 needs to be advanced to bring fresh ribbon 11 to the operation station 14 for a subsequent printing operation.

The ribbon feed system 10 includes a supporting structure which in this embodiment is a base plate 18, carrying a plurality of ribbon transport devices including a ribbon storage spool 19, and a ribbon take up spool 20, and a plurality of ribbon guides, which in this example are all rollers 22 around which the ribbon 11 is entrained. The spools 19, 20 and the rollers 22 are all rotatable relative to the base 18 about respective axes which extend in directions which are all generally normal to the direction of movement of the ribbon 11 along a ribbon feed path. Ribbon 11 may be fed off the storage spool. 19, and pass around the ribbon feed path where the plurality of guide rollers 22 are provided, through the operation station 14, and thence on to the take-up spool 20.

In use, ribbon may be wound from spool 20 to spool 19, for example to effect ribbon saving functionality, in which case the roles of the spools 19, 20 would be reversed with the storage spool 19 becoming the take-up spool and the take-up spool 20, the storage spool. In this description however, single direction ribbon movement is assumed, although the invention may be applied to bi-directional ribbon feed systems.

In this example, each of the spools 19, 20 has a respective drive motor 19*a*, 20*a* which together provide a ribbon transport mechanism. The drive motors 19*a*, 20*a* each have driven shafts which provide axially extending spindles 21, 23 on which the respective storage and take-up spools 19, 20 are rotatably mounted. The drive motors 19*a*, 20*a* are controlled by a controller C which co-ordinates ribbon 11 drive, with printing operations.

In accordance with the invention, each of the storage 19 and take-up 20 spools are mounted on respectively, a first mounting structure 25 and a second mounting structure 26. In this example both the first and second mounting structures 25, 26 are substantially similar and thus only the construction of mounting structure 25 will be described.

The mounting structure 25 includes a mounting part 28 on which the storage spool 19 and its drive motor 19*a* are mounted. The base plate 18 is in this example a plate-like member, and the mounting part 28 is provided as an island in the base plate 18, which is connected to the base plate 18 by a connecting member 30 which provides a bridge.

In this example, the connecting member or bridge 30 is integral with the base plate member 18 and the mounting part 28, and the island mounting part 28 is formed by a space 31 which substantially surrounds the mounting part 28. Thus the mounting part 28 is provided in an opening 33 in the base plate 18.

Because the connecting member or bridge 30 is small, it will be appreciated that during ribbon 11 transport or otherwise e.g. during printing, as tension in the ribbon 11 around the ribbon feed path may change, and the ribbon 11 will tend to exert changing generally radial forces on the spindles 21, 23 on which the spools 19, 20 are mounted, and so small movements of the 10 mounting part 28 relative to the base plate 18 and hence of the spools 19, 20, in directions transverse to the directions of their rotational axes, may occur.

It can be seen that along the space 31, there is a wider space part 35 where a sensor device 36 is provided. The sensor device 36 in this example is a single transducer, preferably a solid state sensor transducer, such as a proximity sensor or strain gauge, which is sensitive to movements of the mounting part 28 relative to the base plate 18 due to changes in the ribbon tension along the ribbon feed path. The transducer 36 provides an input which is a single signal, to the controller C, which thus depends upon the amount of spool 19, 20 movement occurring in response to changes in the tension in the ribbon 11. Thus by suitable calibration, a determination of the tension of the ribbon 11 along the ribbon feed path of the system 10 may be made.

In response to the input from each of the transducers 36 of the first and second mounting structures 25, 26, the controller C may operate the drive motors 19*a*, 20*a* to maintain the tension of the ribbon 11 within predetermined values. Thus if the controller C determines that the ribbon 11 is too taut, the storage spool 19 of the ribbon transport mechanism may be arranged to be driven at a slightly faster rate or the take-up spool 20 at a slightly slower rate to relieve the ribbon tension, and vice versa.

Where the ribbon 11 is moved through the operation station 14 during a printing process, it will be appreciated that the ribbon 11 may be fed at a differential or the same speed as the substrate 12, or in a printing machine P in which the print head 15 too moves during printing, the ribbon 11 and substrate 12 may be driven at the same speed, with the print head 15 speed being adjusted to achieve a desired differential speed between the print head 15 and the substrate 12.

In the example shown in FIG. 1 of the drawings, the analogue signals from the transducers 36 are each conditioned in respective conditioning circuits 32, converted by analogue to digital converters 38, 39 to digital signals, and a determination of ribbon tension is made in the controller C by comparing the input, being the digital signals from the two transducers 36, which in this example, are sensitive to substantially opposite spool movements relative to the base plate 18.

In another example, only one of the spools 19, 20 may be provided on a mounting structure 25, 26 which permits of movement of the spool 19, 20 relative to the base plate 18 in response to changing ribbon tension to be sensed. In this case a single transducer 36 may be provided to sense such movements, and the controller C would be programmed to determine from the one input, the tension of the ribbon 11.

Of course if desired, more than one transducer 36 may be provided for the or each mounting structure 25, 26, the transducers being sensitive to mounting part 28 movements in different directions, or the sensor device 36 may have a plurality of sensing elements arranged in a bridge. In each case, the input to the controller C may thus include one or more signals from the sensor device 36 or devices 36.

It will be appreciated that as the amount of ribbon 11 on each of the storage and take-up spools 19, 20 changes as ribbon is wound onto the take-up spool, and particularly as the ribbon diameters on the respective spools 19, 20 change, ribbon tension will be affected, and resulting movements of the respective mounting structures 25, 26 due to changes in ribbon tension, will change.

Typically the controller C would determine a measure of the respective spool 19, 20 diameters, in order to control rotation of the spools 19, 20 to achieve a desired amount of ribbon 11 feed during and/or subsequent to a printing operation. This may be achieved by calculation or by ribbon diameter measurement as desired, for example using a calibration roller as described with reference to FIG. 3 below.

Accordingly, preferably the controller C not only uses information received from the sensor device or devices 36, but also uses information indicative of the ribbon diameter on at least one of the spools 19, 20 in controlling ribbon transport mechanism operation to control the ribbon 11 tension.

Various modifications may be made to the embodiment shown in FIG. 1 without departing from the scope of the invention.

For example, in the example described, both spools 19, 20 are driven by respective motors 19*a*, 20*a*, but in another example, only the take-up spool 20 may be driven, directly or via a transmission, with the storage spool 19 being dragged via a slipping clutch. In this event, the determination of the ribbon tension may be used by the controller C to control the speed of the take-up spool motor 20*a*. However where there is a controllable slipping clutch, the resistance of the clutch to slipping may be controlled by the controller C depending upon ribbon tension.

In the example described, the motors 19*a*, 20*a* have driven shafts which provide the spindles 21, 23 but in another example the motors 19*a*, 20*a* may drive the spools 19, 20 indirectly through a transmission. In each case, the spools 19, 20 rotate about respective rotational axes which usually are generally normal to the direction of ribbon 11 transport.

In another example, the ribbon 11 may be transported by being entrained about a drive or capstan roller, the controller C controlling the capstan roller in response to inputs from both sensor devices 36, to maintain the tension of the ribbon 11 around the ribbon feed path, within predetermined values.

Although in the examples described, the mounting structures 25, 26 have been provided by islands substantially surrounded by the base plate member 18, and connected to the base plate 18 by integral bridge connecting members 30, in another example, a mounting structure 25, 26 may be provided by a mounting part 28 otherwise connected to the base plate 18, although desirably in an opening in the base plate 18, which may be at an edge of the base plate 18 as desired.

Instead of the sensor device 36 or devices being proximity sensors or strain gauges 36, any other suitable transducers or other sensor devices may be provided, such as for example optical sensor devices, to sense spool 19, 20 movements relative to the base 18 plate as a result of changing ribbon tensions.

It will be appreciated that in the event of a ribbon 11 breakage, the sensor device 36 or devices may sense a more-sudden movement of the mounting part 28 and thus of the spools 19, 20, or at least a respective spool 19, 20, than may otherwise occur in normal use. Accordingly, the input to the controller C may immediately indicate that there has been a ribbon breakage, and the controller C may respond by stopping the or both of the motors 19*a*, 20*a*. Moreover, the controller C may operate an indicating device 40 such as a visual or audible warning, to indicate that a ribbon breakage has occurred. The controller C will know exactly at which point of the operating cycle the ribbon breakage has occurred and this information may be extractable from the controller C for diagnostic use, for example to determine if there is a particular fault with the ribbon feed system 10.

Figure 2:
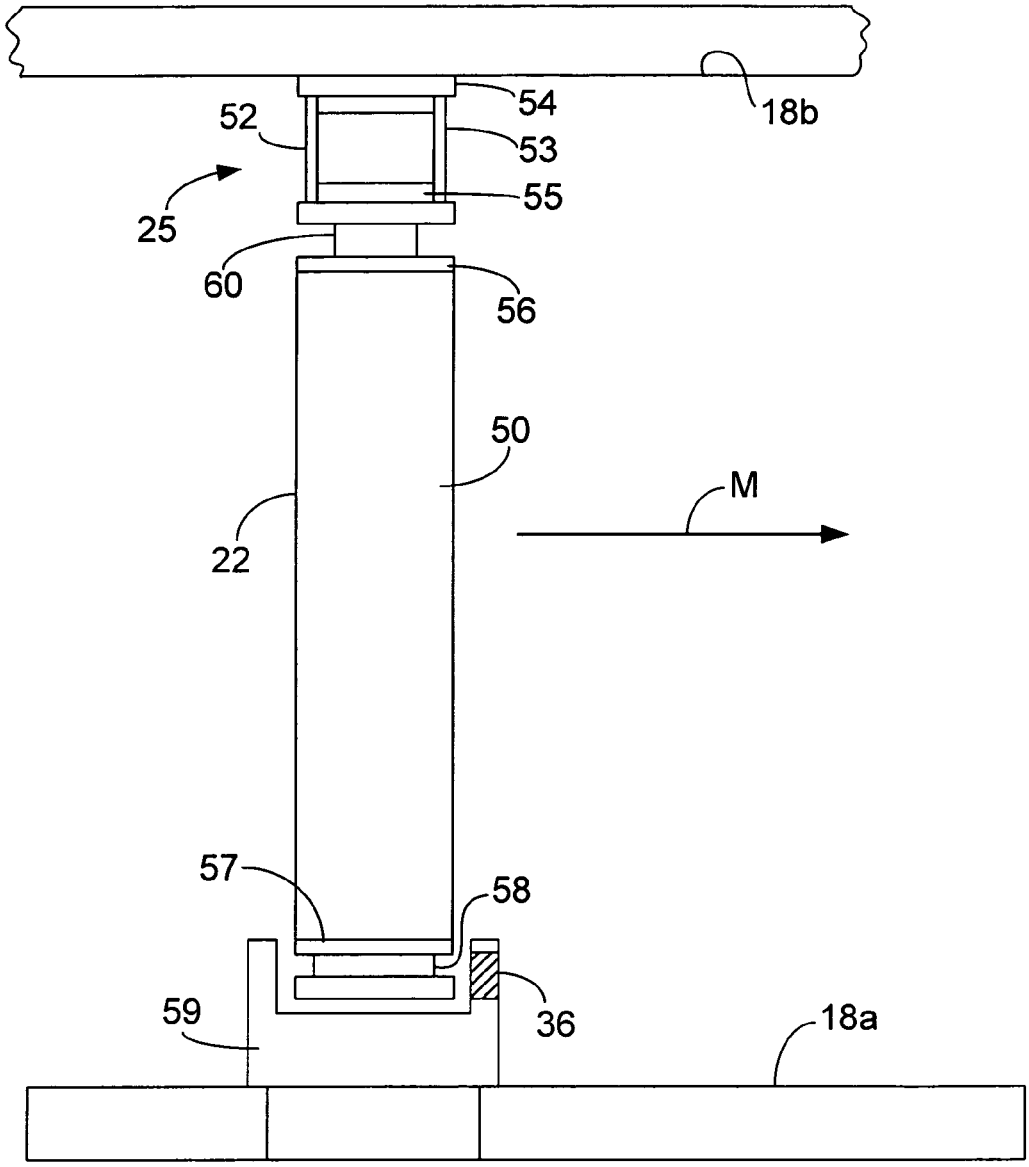
FIG. 2 is an illustrative view of part of a ribbon feed system and an apparatus for determining ribbon tension according to a second embodiment of the invention.

Referring now to FIG. 2, another embodiment is shown, but similar parts to those described with reference to FIG. 1 are indicated by the same references. In FIG. 2 only a part of the printing machine is shown, namely a roller assembly 50 which includes one of the guide rollers 22.

Figure 3:
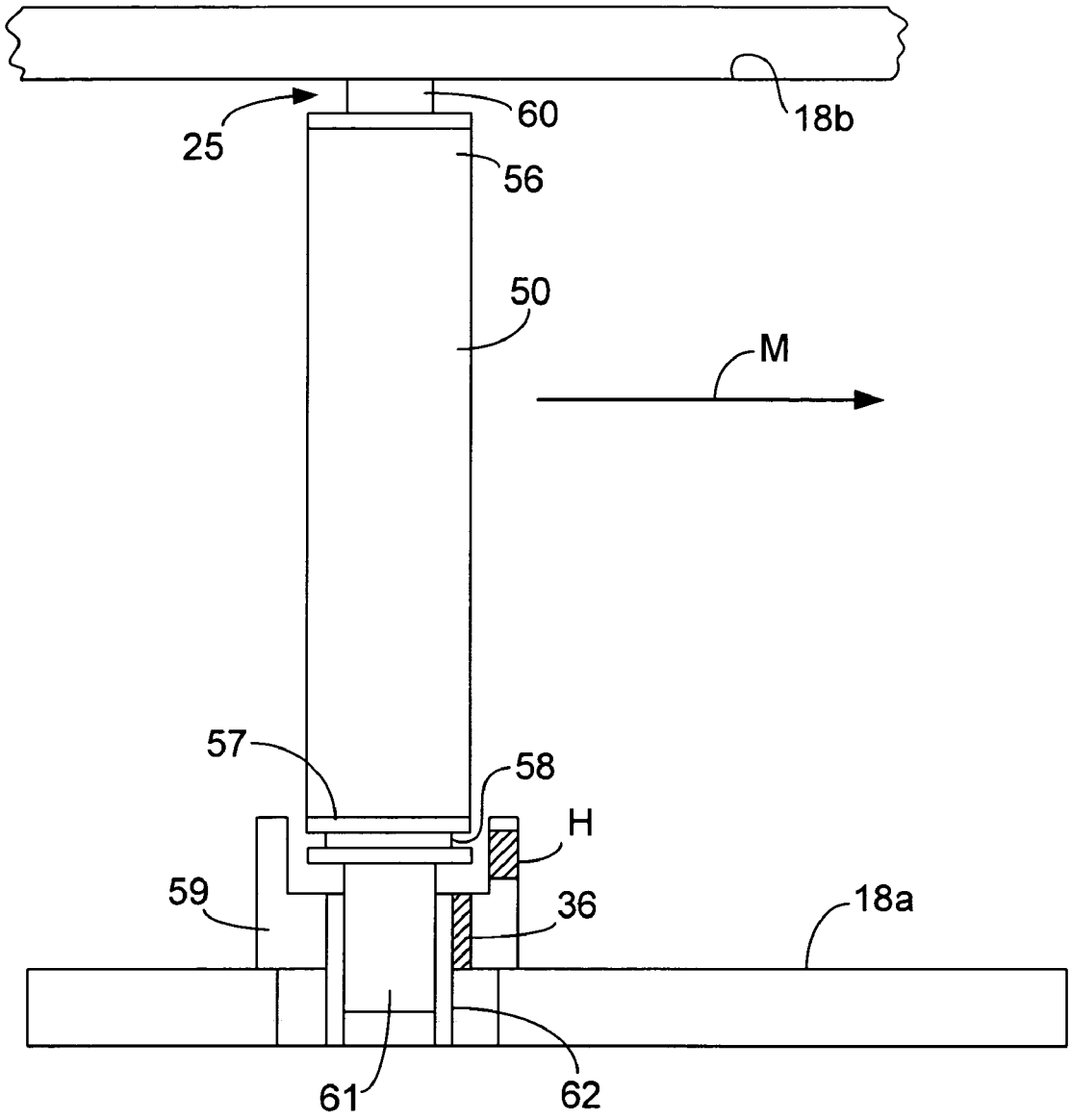
FIG. 3 is a view similar to FIG. 2 but of another version of the second embodiment of the invention.

In the FIG. 1 arrangement, the supporting structure which carries the spools 19, 20 and rollers 22 etc. is provided by a single base plate 18, but in the FIGS. 2 and 3 embodiment, the supporting structure includes a pair of spaced base plates 18*a*, 18*b*. One of the base plates 18*a* is provided by a main superstructure of the printing machine, whereas the other of the base plates 18*b* is provided by a superstructure of a cassette assembly which is removable from the main superstructure of the printing machine to effect ribbon changing, and for maintenance purposes. Thus in the FIGS. 2 and 3 arrangements, the ribbon transport devices being the spools 19, 20, may be carried by the plate 18*b* of the cassette assembly, whilst at least one of the rollers 22 may be carried by the main superstructure base plate 18*a* of the printing machine or the superstructure base plate 18*b* of the cassette assembly as desired.

Referring again to FIG. 2, a mounting structure 25 mounts the roller 22 of the roller assembly 50 with respect to the cassette assembly superstructure base plate 18*b* at or adjacent one end 56 of the roller 22. The roller 22 is carried on a spindle 60 which is secured relative to the mounting structure 25. The mounting structure 25 includes a pair of spaced apart springs 52, 53 which in this example are leaf springs, which extend generally parallel to each other and to an axis of rotation of the roller 22. The leaf springs 52, 53 are interconnected at or adjacent their ends by transverse connecting parts 54, 55 so that the mounting structure 25 is a box which allows the roller 22 to move in response to changes in ribbon tension in the ribbon feed path sideways, i.e. transverse or generally normal to the axis of rotation of the roller 22 and generally normally to the extents of the leaf springs 52, 53 when they are in unstressed condition as shown in the figure.

During such movement in the direction of the arrow M, which indicates the general direction of pull of the ribbon 11 as ribbon tension increases, the box formed by the leaf springs 52, 53 and transverse connecting parts 54, 55 is deformed into a trapezium or parallelogram shape.

At or towards an opposite end 57 of the roller 22 there is provided a magnet 58, such as a rod magnet, which is received by a housing 59 secured to the main printer superstructure base plate 18*a*. The magnet 58 in this example is fixed with respect to the spindle 60 and thus is non-rotatable with the roller 22. The housing 59 includes a sensor device 36 being a Hall effect transducer in this example, which senses the proximity of the magnet 58 to provide an input to the controller C in the same manner as the sensor devices 36 described with reference to the FIG. 1 embodiment.

The input from the sensor device 36 in the housing 59 will indicate the extent of movement of the roller 22 in response to changes in ribbon tension in the ribbon feed path occurring, as changes in ribbon tension will tend to move the roller 22 in the direction of arrow M to bring the magnet 59 and the sensor device 36 closer together, and vice versa.

By virtue of the mounting structure 25 in FIG. 2 permitting of transverse or sideways movement of the roller 22 as described, creasing of the ribbon 11 as it passes around the roller 22, which could occur if the roller 22 was moved angularly with respect to the supporting structure base plate 18*b*, is at least lessened, and the ribbon 11 is less likely to migrate along the roller 22.

As in FIG. 1, where the ribbon transport mechanism is provided by motors which drive the spools, a measure of the amount of ribbon on the storage and take-up spools 19, 20 of the printing machine would be required to enable the controller to control the spool motors 19*a*, 20*a*, or single spool motor 20*a*.

Where the changes in diameters of the spools 19, 20 affect the roller 22 movement in response to the changing ribbon tension, for example as the enclosed angle between the ribbon passing to the roller 22 and the ribbon 11 passing from the roller 22 changes with changing spool diameter, a measure of the amount of ribbon on the or the respective spools 19, 20 may be taken into account by the controller C to help maintain the ribbon tension in the ribbon feed path within predetermined values.

Referring now to FIG. 3, similar parts to those indicated in FIGS. 1 and 2 are again labelled by the same references.

In FIG. 3, again a roller 22 is mounted at or towards one end 56 by a mounting structure 26, details of which are not shown, which mounting structure 25 permits some non-rotational movement of the roller 22 in response to changes in ribbon tension in the ribbon feed path. However, in this example, the opposite end 57 of the roller 22 is not free to move sideways as is the corresponding roller end of the FIG. 2 embodiment. Rather, in the FIG. 3 embodiment, the roller end 57 is constrained by the housing 59 as follows.

The roller assembly 50 includes a spindle 60 which is secured by the mounting structure 25 to the cassette base plate 18*b* and extends throughout the length of the roller 22 and beyond so that the spindle 60 provides an end part 61 which is received by a bush or bearing 62 in the housing 59. Sideways movements of the end part 61 are sensed by a sensing device 36 which is a strain gauge located by the housing 59. Thus movements, or attempted movements of the end part 61 and hence the roller 22 are constrained, but the strain gauge 36 will again provide an input to the controller C which is dependent upon ribbon tension in the ribbon feed path, which tension exerts a transverse or sideways force on the roller 22 in the direction indicated by the arrow M, or oppositely.

Again a measure of the amount of ribbon 11 on the storage and take-up spools 19, 20 of the printing machine would be required to enable the controller to control the ribbon feed mechanism, where this is provided by spool motors 19*a*, 20*a*, or a single spool motor 20*a* to enable an appropriate amount of ribbon to be fed for a work operation, and possibly also to help in enabling the controller C to maintain the ribbon tension in the ribbon feed path within predetermined values.

In the FIG. 3 embodiment, the roller 22 not only guides the ribbon 11 around the ribbon feed path, but also enables a determination to be made of the amount of ribbon 11 on each of the respective storage and take-up spools 19, 20.

This is achieved by providing the roller 22 at the end 57 adjacent the main superstructure base plate 18*c*, with a magnet, such as a rod magnet 58 which rotates with the roller 22 about the spindle 60. This magnet 58 and thus roller 22 rotation is sensed by a Hall effect sensor H also provided by housing 59, which Hall effect sensor H provides an input to the controller C.

Thus the amount of ribbon 11 fed along the ribbon feed path from the storage spool 19 to the take-up spool 20 may be determined by sensing rotations of the roller 22. Desirably, a calibration may be carried out, as described in our previous patent application number WO96/28304, under controlled conditions, to determine how much ribbon 11, is on at least the storage spool 19, and hence the diameter of the ribbon on the storage spool 19, so that the ribbon transport mechanism may more accurately be controlled by the controller C subsequently, to maintain ribbon tension within predetermined values.

It will be appreciated that for both of the FIG. 2 and FIG. 3 embodiments, various modifications may be made without departing from the scope of the invention.

For example, ribbon transport may be effected by a capstan drive or otherwise instead of by spool motors 19*a*, 20*a*. Instead of a Hall effect sensor device 36 in FIG. 2, another preferably solid state proximity sensor device may alternatively be used, and in FIG. 3, instead of a strain gauge 36, another sensor device may be used. Again any suitable sensor device, with one or more sensing elements, to provide an input, which may include one or more than one signal indicative of roller 22 movement in one or more than one direction relative to the support structure 18, in response to changing ribbon tension, may be used.

The circuitry for conditioning the input signal from the respective sensor device or devices 36, in FIG. 1 may be used for conditioning the signal from the sensor device or devices 36 in either of the FIGS. 2 and 3 embodiments, or alternative signal conditioning circuitry may be used.

If desired, in another ribbon feed system, a plurality of the rollers 22 around the ribbon feed path may each have sensor devices 36 to provide inputs to the controller C so that changes in tape tension in more than one direction (e.g. as indicated by arrow M) sensed by different movements of the plurality of ribbon transport devices, may be used by the controller C to control the ribbon transport mechanism.

In the FIGS. 2 and 3 embodiments, the or one of the ribbon guides, instead of being rollers 22, may be simple posts around which the ribbon 11 passes, with post movement in response to changing ribbon tensions being sensed.

With suitable modification, one of the rollers 22 described may be a driven capstan roller rather to effect ribbon transport around the ribbon feed path.

The apparatus described with reference to FIG. 2 or FIG. 3 may be used to determine ribbon breakage by the respective sensing device 36 sensing an unusual or extraordinary roller 22 movement, and the controller C may thus provide a visual and/or audible indication that ribbon breakage has occurred.

The invention claimed is:

1. An apparatus for controlling a ribbon transport mechanism of a ribbon feed system which includes a supporting structure supporting a plurality of ribbon transport devices including a ribbon storage spool, a ribbon take-up spool, and at least one ribbon guide around which the ribbon is passed, there being a ribbon feed path including the ribbon guide, between the storage and take-up spools through an operating station where a work operation is carried out which utilises the ribbon, the ribbon transport mechanism in use, transporting the ribbon along the ribbon feed path between the storage and take-up spools, at least one of the ribbon transport devices including a spindle which extends along an axis generally normal to the direction of ribbon transportation, the apparatus including a mounting structure for mounting the spindle of at least one of the ribbon transport devices at one end so as to permit the respective spindle to move relative to the supporting structure in a direction transverse to the spindle axis in response to changing generally radial forces exerted on the spindle as changes in ribbon tension occurrin the ribbon feed path, and a sensor device which is sensitive to such movements to provide an input which is dependant upon the extent of such movement, to a controller, the controller controlling operation of the ribbon transport mechanism in response.

2. An apparatus according to claim 1 wherein each of the ribbon take-up, and ribbon storage spools are rotatable about a respective rotational axes.

3. An apparatus according to claim 2 wherein each of the rotational axes of the spools are generally normal to the direction of ribbon movement around the ribbon feed path.

4. An apparatus according to claim 3 wherein the ribbon guide too has an axis generally normal to the direction of ribbon movement.

5. An apparatus according to claim 3 wherein the sensed movement of the respective ribbon transport device relative to the supporting structure is in a direction transverse to the direction of the respective axis of the device.

6. An apparatus for controlling a ribbon transport mechanism of a ribbon feed system which includes a supporting structure supporting a plurality of ribbon transport devices including a ribbon storage spool, a ribbon take-up spool, and at least one ribbon guide around which the ribbon is passed, there being a ribbon feed path including the ribbon guide, between the storage and take-up spools through an operating station where a work operation is carried out which utilises the ribbon, the ribbon transport mechanism in use, transporting the ribbon along the ribbon feed path between the storage and take-up spools, the apparatus including for the storage spool, a first mounting structure, and for the take-up spool, a second mounting structure, both of the first and second mounting structures permitting respective spool movements relative to the supporting structure in response to changes in ribbon tension, and there being a sensor device for each mounting structure to sense spool movements attributable to changes occurring in the ribbon tension, each of the sensors to provide an input which is dependant upon the extent of the corresponding spool movement, to a controller, the controller controlling operation of the ribbon transport mechanism in response.

7. An apparatus according to claim 6 wherein the ribbon transport mechanism includes a motor for each of the storage and take-up spools, which motors are individually controlled by the controller in response to the inputs from the respective sensor devices, to maintain ribbon tension predetermined values.

8. An apparatus according to claim 7 wherein the controller determines a measure of the or at least one of the respective spool diameters, in order to control rotation of the spools to achieve a desired amount of ribbon feed during or subsequent to a work operation.

9. An apparatus according to claim 6 wherein the first mounting structure or the second mounting structure includes a spool mounting part provided in an opening in the supporting structure.

10. An apparatus according to claim 9 wherein the spool mounting part is attached to the supporting structure by a connecting member which permits the spool mounting part, and hence the spool, to move relative to the supporting structure in response to changes in ribbon tension.

11. An apparatus according to claim 10 wherein the supporting structure includes a plate-like member providing the opening, and the connecting member includes a bridge which is integral with the plate-like member and the spool mounting part.

12. An apparatus according to claim 11 wherein at least one of the sensor devices includes at least one transducer provided between the supporting structure and the spool mounting part to sense movements of the spool mounting part relative the to supporting structure.

13. An apparatus according to claim 12 wherein the or each transducer is a proximity sensor, or a strain gauge.

14. An apparatus according to claim 10 wherein the opening in the supporting structure in which the spool mounting part is provided, substantially surrounds the spool mounting part.

15. An apparatus according to claim 9 including a spindle on which the spool is mounted.

16. An apparatus according to claim 15 wherein the spindle is a driven shaft of a motor, the rotation of which to achieve ribbon transport, is controlled by the controller.

17. An apparatus for controlling a ribbon transport mechanism of a ribbon feed system which includes a supporting structure supporting a plurality of ribbon transport devices including a ribbon storage spool, a ribbon take-up spool, and at least one ribbon guide around which the ribbon is passed, there being a ribbon feed path including the ribbon guide, between the storage and take-up spools through an operating station where a work operation is carried out which utilises the ribbon, the ribbon transport mechanism in use, transporting the ribbon along the ribbon feed path between the storage and take-up spools, the ribbon guide being a roller of a roller assembly, the apparatus including a mounting structure for mounting the roller assembly so as to permit the roller assembly to move relative to the supporting structure, wherein the mounting structure mounts the roller assembly on the supporting structure, at or towards one end of the roller, the mounting structure constraining the roller to move in a direction generally transverse to the direction of the longitudinal axis of the roller in response to changes in tension in the ribbon in the ribbon feed path, the apparatus further including a sensor device, the sensor device including at least one proximity sensor provided on the supporting structure at or towards an opposite end of the roller to the mounting structure, to sense roller movements occurring in response to changes in ribbon tension and to provide the input to a controller, the controller controlling operation of the ribbon transport mechanism in response.

18. An apparatus according to claim 17 wherein the mounting structure includes a pair of spaced apart leaf springs arranged generally parallel to each other and to the axis of rotation of the roller, the leaf springs being interconnected by upper and lower connecting members which each extend generally normally to the axis of rotation of the roller, whereby in response to changes in tension of the ribbon along the ribbon feed path, the springs resiliently distort to constrain the roller to move sideways in a direction generally normally to the direction of the longitudinal axis of the roller.

19. An apparatus for controlling a ribbon transport mechanism of a ribbon feed system which includes a supporting structure supporting a plurality of ribbon transport devices including a ribbon storage spool, a ribbon take-up spool, and at least one ribbon guide around which the ribbon is passed, there being a ribbon feed path including the ribbon guide, between the storage and take-up spools through an operating station where a work operation is carried out which utilises the ribbon, the ribbon transport mechanism in use, transporting the ribbon along the ribbon feed path between the storage and take-up spools, the ribbon guide being a roller of a roller assembly, the apparatus including a mounting structure for mounting the roller assembly so as to permit the roller assembly to move relative to the supporting structure wherein the mounting structure mounts a spindle of the roller assembly on the supporting structure at or towards the one end of the roller, an end part of the roller assembly at or towards an opposite end of the roller being received by a housing which includes a sensor device and which sensor device senses movements of the end part in response to changes in ribbon tension to provide the input to a controller, the controller controlling operation of the ribbon transport mechanism in response.

20. An apparatus according to claim 19 wherein the sensor device includes a solid state transducer or combination of transducers.

21. A method of controlling a ribbon transport mechanism of a ribbon feed system which includes a supporting structure carrying a plurality of ribbon transport devices including a ribbon storage spool, a ribbon take-up spool, and at least one roller guide around which roller the ribbon is passed, a ribbon path including the ribbon guide, between the storage and take-up spools through an operating station where a work operation is carried out which utilises the ribbon, the ribbon transport mechanism in use, transporting the ribbon along the feed path between the storage and take-up spools, the method including providing the ribbon transport devices on mounting structures which permits the devices to move relative to the supporting structure in response to changes in ribbon tension occurring in the ribbon feed path, and sensing such movements with a sensor devices, the method including sensing movements of both of the ribbon storage and take-up spools in response to changes in ribbon tension, with respective sensor devices, and providing inputs dependent upon the extents of spool movements from the sensor devices to a controller, the controller controlling operation of the ribbon transport mechanism in response.

* * * * *